US006095707A

United States Patent [19]

Kaufmann

[11] Patent Number: 6,095,707

[45] Date of Patent: Aug. 1, 2000

[54] WRITING UTENSIL WITH A CONTAINER FOR RECEIVING FREELY A WRITING LIQUID

[76] Inventor: Rainer Kaufmann, Schanzenstrasse 36, D-27753 Delmenhorst, Germany

[21] Appl. No.: 08/150,085

[22] PCT Filed: Apr. 30, 1992

[86] PCT No.: PCT/DE92/00361

§ 371 Date: Nov. 12, 1993

§ 102(e) Date: Nov. 12, 1993

[87] PCT Pub. No.: WO92/20530

PCT Pub. Date: Nov. 26, 1992

[30] Foreign Application Priority Data

May 14, 1991 [DE] Germany ..... 41 15 685

[51] Int. Cl.[7] ..... B43K 5/00

[52] U.S. Cl. ..... 401/199; 401/198

[58] Field of Search ..... 401/198, 199, 401/196, 201, 203, 205

[56] References Cited

U.S. PATENT DOCUMENTS

| | | | |
|---|---|---|---|
| 1,166,896 | 1/1916 | Garvey | 401/198 |
| 2,740,979 | 4/1956 | Bridy | 401/198 |
| 3,113,336 | 12/1963 | Langwickel | 401/199 X |
| 3,479,122 | 11/1969 | Funahashi | 401/199 |
| 3,501,225 | 3/1970 | Martin et al. . | |
| 3,922,100 | 11/1975 | Saito | 401/199 |
| 3,993,409 | 11/1976 | Hart | 401/199 |
| 4,496,258 | 1/1985 | Tanaka et al. | 401/199 X |
| 4,588,319 | 5/1986 | Niemeyer | 401/198 X |
| 4,770,558 | 9/1988 | Frietsch | 401/199 X |

FOREIGN PATENT DOCUMENTS

| | | | |
|---|---|---|---|
| 0459146 | 4/1991 | European Pat. Off. . | |
| 87610 | 9/1966 | France | 401/199 |
| 2124298 | 11/1972 | Germany | 401/199 |
| 2424918 | 4/1975 | Germany | 401/199 |
| 3642037 | 12/1986 | Germany . | |
| 3642037 | 6/1988 | Germany | 401/199 |
| 3824941 | 2/1990 | Germany | 401/198 |
| 7701595 | 8/1978 | Netherlands | 401/199 |
| 422575 | 4/1967 | Switzerland . | |
| 941439 | 11/1963 | United Kingdom | 401/198 |

*Primary Examiner*—David J. Walczak

*Attorney, Agent, or Firm*—Oppenheimer Wolff & Donnelly LLP

[57] ABSTRACT

A writing utensil has a container with an opening for receiving a writing liquid and a writing tip. An at least partially capillary conveying line is provided and connected between the opening of the container and the writing tip for conveying the writing liquid from the container to the writing tip. The conveying line completely fills the opening. A capillary storage directly communicates with the conveying line. The average capillary effect of the capillary storage is smaller than the average capillary effect of the conveying line, at least in the opening.

16 Claims, 2 Drawing Sheets

WRITING UTENSIL WITH A CONTAINER FOR RECEIVING FREELY A WRITING LIQUID

BACKGROUND OF THE INVENTION

The invention relates to a writing utensil, comprising a container having an opening, in which container writing liquid is freely received, one conveying line that is at least partially capillary for the writing liquid, that connects the container to the writing tip for conveying the writing liquid, and a capillary storage communicating with the conveying line.

In writing utensils of this kind a classical closed system is present in which the writing liquid is prevented from leakage by vacuum. For example, fountain pens that have been known for decades are designed according to such a system. Writing utensils of this kind have a special disadvantage that is experienced by almost all users of fountain pens in a more or less misfortunate manner. When the container containing the writing liquid in a free manner, i.e., in a non-capillary manner, has been emptied partially by using the writing utensil, in the writing position of the writing utensil writing liquid may escape from the container due to temperature related air expansion. In order to be able to receive this writing liquid in such a scenario at least partially, i.e., that portion that in general would escape due to air expansion, a capillary storage is provided, for example, in a fountain pen under the pen nib. The capillarity of such a storage must be so great that in the writing position the writing liquid cannot leak from it, but, on the other hand, so small that the storage is not filled during normal writing operation, thus being unable to receive the writing liquid during the aforementioned scenario of air expansion. Such a capillary relation is, as is known in the prior art, to a certain degree realized in classical fountain pens.

However, it has been demonstrated that this solution, due to the relatively narrow limits of air expansion and the relatively small volume of writing liquid in the container for which this known system is operable, cannot be employed for larger containers for writing liquids and for greater limits of air expansion.

It is an object of the present invention to provide a writing utensil of the aforementioned kind that, for great air expansion fluctuations and also for a great container volume in comparison to known systems, functions reliably for receiving writing liquid without allowing the uncontrolled leakage of writing liquid from the writing utensil, independent of the momentary filling degree of the container with writing liquid, whereby the writing utensil should be simple and inexpensive in its production.

SUMMARY OF THE INVENTION

This object is solved with the present invention by providing the conveying line in direct contact with the capillary storage whereby the average capillarity of the capillary storage is less than the average capillarity of the conveying line, at least in the opening of the container.

The inventive writing utensil is primarily characterized by:

a container for receiving a writing liquid, the container having an opening;

a writing tip;

an at least partially capillary conveying line, connected between the opening of the container and the writing tip, for conveying the writing liquid from the container to the writing tip, wherein the conveying line completely fills the opening;

a capillary storage directly communicating with the conveying line; and wherein an average capillary effect of the capillary storage is smaller than an average capillary effect of the conveying line at least in the opening.

Preferably, the conveying line extends into the vicinity of a bottom of the container. Advantageously, the capillary storage also extends into the vicinity of the bottom of the container.

The conveying line and the capillary storage are expediently one unitary part.

Advantageously, the conveying line and the capillary storage are tapered so as to be received in the opening.

In a preferred embodiment, the conveying line has a separate member that is received in the opening.

The conveying line and/or the capillary storage is comprised of a material with a capillary structure which may be a porous and/or fibrous structure.

The essential advantage of the inventive writing utensil is that, as desired, it functions reliably even for greater temperature fluctuations and resulting greater air expansion limits even for a greater volume of writing liquid, of for example, 10 ml or more. This is substantially caused by the fact that air continuously can be exchanged in both directions via the greater capillaries of the conveying line in the opening and that additionally, continuously a certain amount of finer capillaries of the conveying line in the opening provide for the conveying of the writing liquid in parallel. This is not the case in writing utensils of the aforementioned kind, for example, for the known fountain pens, which have defined capillaries of a certain size. Here, an air inclusion in the capillary storage is sufficient to cause undefined conditions in the system with the result that the writing liquid leaks in an undesired manner.

In a preferred embodiment, the conveying line extends into the bottom area of the container which results in that the utensil must not be of an excessive length when greater container volumes are desired.

In another advantageous embodiment of the writing utensil, the capillary storage also extends into the bottom area of the container so that, conjunction with the embodiment of the conveying line extending into the bottom area of the container such that the conveying line is over its entire length surrounded by the storage, the leakage safety is increased because in the writing position the supply of writing liquid from the container is interrupted. The conveying line itself then represents the reservoir proper from which writing liquid is supplied for writing.

In another embodiment of the present invention it is advantageous that the conveying line and the capillary storage are integrally formed, i.e., that the part consisting of the conveying line and the storage is manufactured in one processing step, which allows for further decrease of manufacturing costs.

In order to ensure in this context that for conveying the writing liquid in the area of the opening there is still a sufficient amount of fine capillaries provided, the capillary storage, which also functions as the conveying line for the writing liquid, is pinched together in the area of the opening of the container in a defined manner.

Furthermore, it is advantageous that in another embodiment of the writing utensil the capillary portion of the conveying line which is arranged in the opening, is embodied as a separate part, i.e., in the manner of a capillary part, that is, connected with the capillary storage, directly positioned in the opening of the container.

Even though in general the conveying line and the storage may be embodied in any suitable manner, it is advantageous that the conveying line and/or the storage are embodied such that they have a capillary structure.

It is furthermore advantageous that the conveying line and/or the storage are made of a porous and/or fibrous material.

BRIEF DESCRIPTION OF THE DRAWINGS

The invention will be described in detail with the aid of the following schematic drawings of specific embodiments. It is shown in.

DESCRIPTION OF PREFERRED EMBODIMENTS

Figure 1:
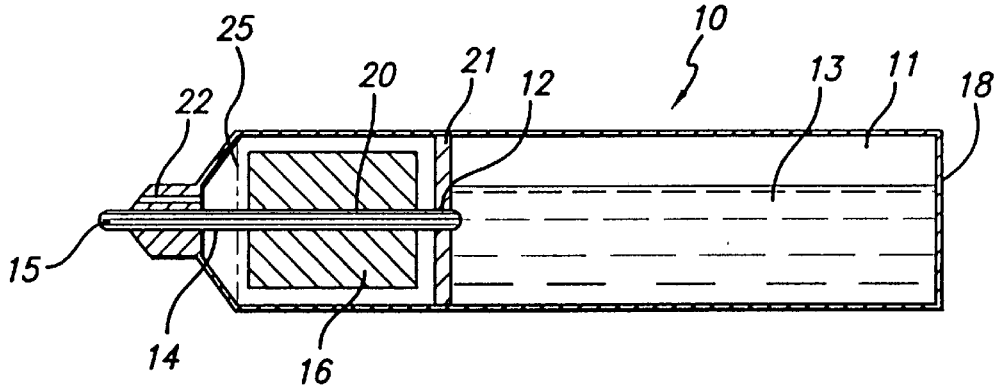
FIG. 1 a section of a writing utensil.

The writing utensil 10 is comprised substantially of a housing 20 in which a container for receiving writing liquid 13 is arranged with the aid of a partition 21. It is to be understood that the partition 21 in the Figures only schematically represents a boundary of the container 11. The container 11 can be embodied in any suitable manner either as an integral part of the housing 20 or as a separate part connected to the housing 20. From one end of the housing 20 at a writing tip 15 extends in a known manner, which writing tip may be embodied in any suitable manner. The interior 25 of the housing which is formed between the partition 21 and the writing tip 15 is connected via an air inlet 22 with the exterior for a free inflow and outflow of air.

In the area of the partition 21 an opening 12 of the container 11 is provided which, as can be seen in FIG. 1, is closed by a capillary conveying line 14. The capillary conveying line 14 extends from the opening 12 to the writing tip 15 whereby the writing tip 15, in principle, may be embodied as an integral part of the conveying line 14. The conveying line 14 is in direct contact with a capillary storage 16 which, according to the representation of FIG. 1, is directly arranged about the capillary conveying line 16. The capillarity of the capillary storage 16 on the average is smaller than the average capillarity of the conveying line 14, at least within the opening 12 of the container 11.

It is to be understood that the strict separation between the capillary storage 16 and the conveying line 14, as represented in FIG. 1, in practice must not be realized. Instead, a mixture of porous and/or fibrous materials may be provided in which always a distribution, see FIG. 2, of finer and greater capillaries within the respective material that forms the capillary storage 16 and the conveying line 14 is provided.

Figure 3:
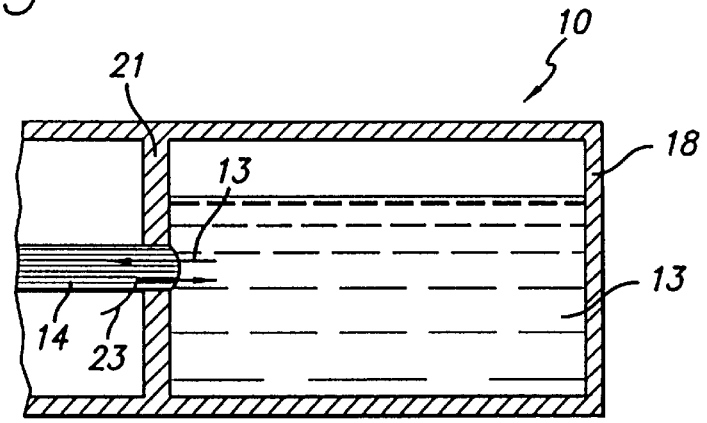
FIG. 3 a detail of the representation of FIG. 1 for illustrating the air inlet mechanism and the writing liquid exit mechanism.

During operation of the writing utensil 10, the capillary material of the conveying line 14 that fills the opening 12 is always filled, mostly with writing liquid 13, wherein the greatest capillary of the porous capillary material of the conveying line functions as an air inlet capillary and the finer capillaries, in contrast, serve as a conveying line 14 to the writing tip 15, see also FIG. 3.

Figure 2:
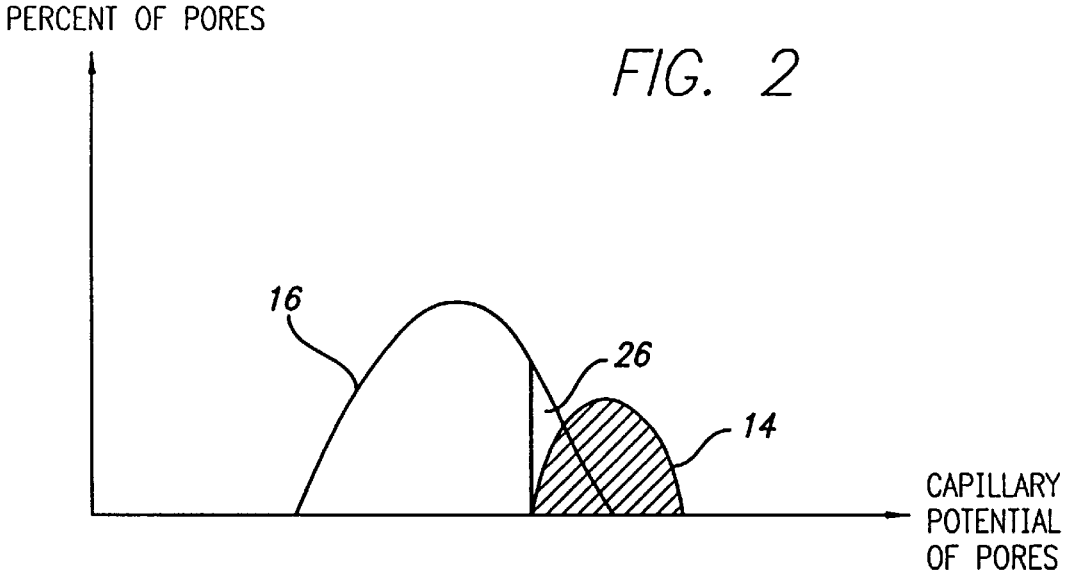
FIG. 2 a diagram in which the capillary potential of the pores of the storage and of the conveying line in the area of the opening are plotted against the percentage of pores of the volume of the porous material.

The capillary storage 16 in principle, can be filled to such an extent as it contains a portion of capillaries which have a higher or identical capillarity as the capillaries that serve for supplying air, i.e., all those in the overlapping portion 26 of FIG. 2. In this relation, which must be observed when selecting the respective capillary material, the capillary storage 16 under normal conditions case remains empty. When due to a temperature increase an air expansion takes place within the container 11, the writing liquid 13 is transferred through the opening 12 via the conveying line 14 into the capillary storage 16, i.e., the capillary storage 16 in this case receives the "excess" writing liquid 13 and prevents an uncontrolled leakage of writing liquid 13 from the writing tip 15, respectively, the writing utensil 10.

Figure 4:
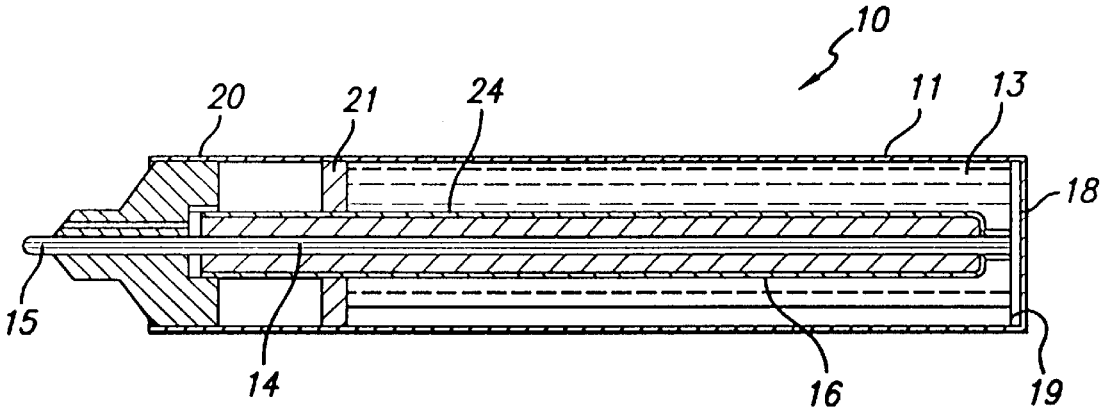
FIG. 4 a writing utensil in which the conveying line and the capillary storage surrounding the conveying line extend into the bottom area of the container.
Figure 6:
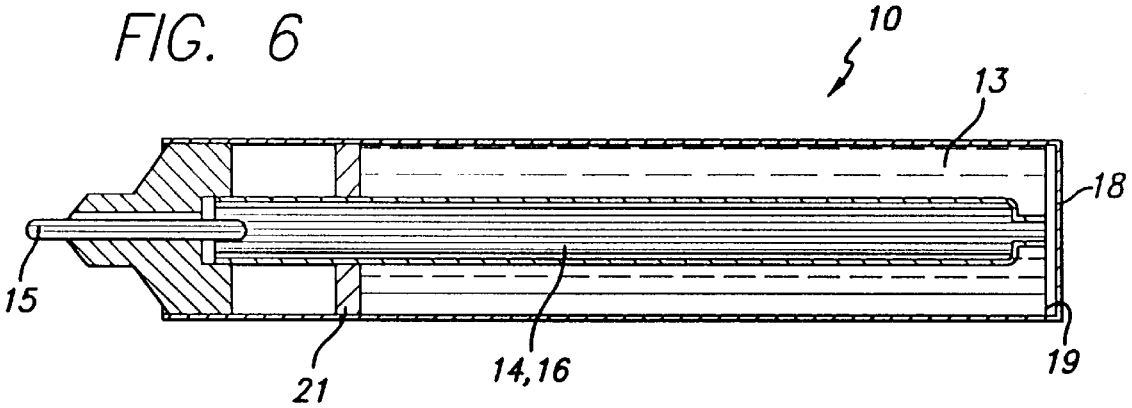
FIG. 6 is an embodiment of the writing utensil according to FIG. 5 in which however the capillary storage integrally formed with the conveying line extends into the bottom area of the container, as shown in the embodiment of FIG. 4.

In the embodiments represented in FIGS. 4 and 6, the capillary storage 16 extends into the area 19 of the bottom 18 of the container 11. The embodiment according to FIG. 4 differs from the embodiment of FIG. 6 such that in contrast to FIG. 4, in which the capillary storage 16 is separate from the capillary conveying line 14 which also extends into the area 19 of the bottom 18, while in the embodiment according to FIG. 6 a mixture of porous materials with greater and smaller capillaries is provided which together form the capillary storage 16 and the conveying line 14. In the embodiment according to FIGS. 4 and 6 the capillary storage, respectively, the unit of capillary storage 16 and the conveying line 14 is enclosed by a separate tube 24 so that the safety with respect to leakage is additionally increased because in the writing position the flow of writing liquid 13 is interrupted since the flow of writing liquid into the conveying line 14, respectively, the mixture of conveying line 14 in capillary storage 16 can only take place via the bottom area.

In this case the capillary storage 16 represents the reservoir proper for the writing liquid from which writing liquid is being used for writing.

Figure 5:
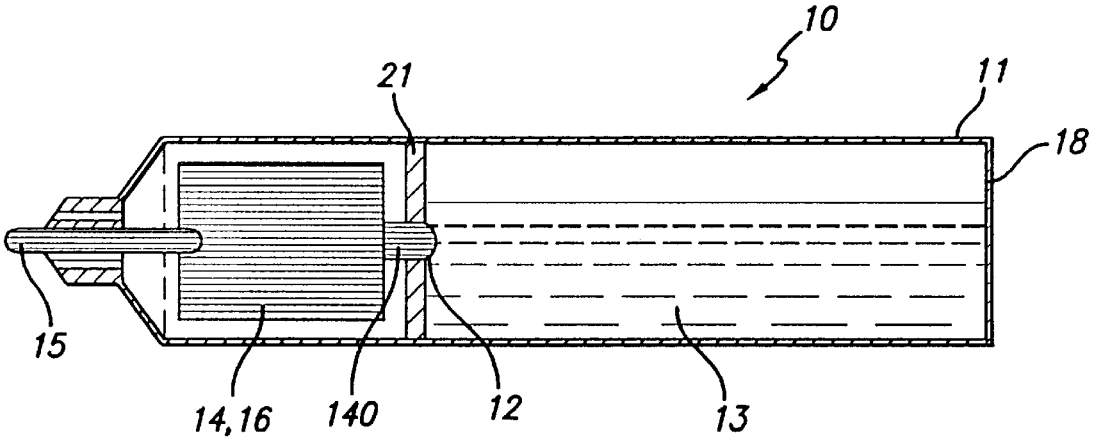
FIG. 5 an embodiment of the writing utensil in which the capillary storage and the conveying line are integrally formed and taper off to fill the opening of the containers.

In the embodiment according to FIG. 5 the conveying line 14 and the capillary storage are provided as a unitary part, similar to the embodiment of FIG. 6; however, in the embodiment of FIG. 5 the integral part of conveying line 14 and capillary storage 16 is tapered for being received in the opening. However, it may also be useful to provide the capillary portion 140 of the conveying line 14 which is positioned in the opening 12, as a separate part.

The inventive writing utensil 10 functions even for a multiple back and forth transport of the writing liquid 13 between container 11 and capillary storage 16 upon temperature fluctuations. It is always ensured that continuously the entire writing liquid 13 is returned from the capillary storage 16 into the container 11, because otherwise the capillary storage 16 would slowly overflow. Since the conveying line 14 is continuously wetted with writing liquid 13 at least in the area of the opening 12, air 23 cannot interrupt the return of writing liquid 13 because at all times a certain number of capillaries is provided for the transport of the writing liquid 13 parallel to a possible air inclusion.

The present invention is, of course, in no way restricted to the specific disclosure of the specification and drawings, but also encompasses any modifications within the scope of the appended claims.

What is claimed is:

1. A utensil for dispensing fluid, comprising:

a container defining a first storage area for storing a relatively large volume of liquid in such a manner that the liquid is allowed to flow freely therein, a second storage area separated from the first storage area, and an opening extending from the first storage area to the second storage area;

a tip;

capillary conveying material, including a capillary conveying line, completely filling the opening, the capillary conveying line extending from the opening, through at least a portion of the second storage space to the tip and defining a first predetermined average capillarity; and a capillary storage associated with the second storage area, in direct contact with the capillary conveying line, and separated from the first storage area such that the capillary storage only comes into contact with liquid from the first storage area by way of the conveying line, the capillary storage defining a second predetermined average capillarity, the second predetermined average capillarity being substantially less than the first predetermined average capillarity.

2. A utensil as claimed in claim 1, further comprising:

a barrier between the first and second storage areas, the barrier having a hole which defines the opening extending from the first storage area to the second storage area.

3. A utensil as claimed in claim 1, wherein the barrier comprises a tube.

4. A utensil as claimed in claim 3, wherein the tube extends to approximately the bottom of the container and the opening is substantially adjacent to the bottom of the container.

5. A utensil as claimed in claim 1, wherein the tip comprises a writing tip.

6. A utensil as claimed in claim 1, wherein the capillary conveying line and the capillary storage define a single unitary structure.

7. A utensil as claimed in claim 1, wherein the capillary conveying line comprises at least one of a porous material and fibrous material.

8. A utensil as claimed in claim 1, wherein the capillary storage comprises at least one of a porous material and fibrous material.

9. A utensil for dispensing fluid, comprising:

a container defining a first storage area for storing a relatively large volume of liquid in such a manner that the liquid is allowed to flow freely therein, a second storage area and a barrier separating the first and second storage areas, the barrier including an opening defining a predetermined space extending from the first storage area to the second storage area;

a tip;

a capillary conveying line, including first capillaries adapted to transport air and second capillaries adapted to transport liquid, completely filling the predetermined space defined by the opening in the barrier, the capillary conveying line extending from the opening, through at least a portion of the second storage space to the tip and defining a first predetermined average capillarity; and a capillary storage associated with the second storage area, in direct contact with the capillary conveying line, and separated from the first storage area by the barrier and the capillary conveying line such that the capillary storage only comes into contact with liquid from the first storage area by way of the conveying line, the capillary storage defining a second predetermined average capillarity, the second predetermined average capillarity being substantially less than the first predetermined average capillarity.

10. A utensil as claimed in claim 9, wherein the capillary storage comprises a plurality of storage capillaries ranging in capillarity, at least some of the conveying line capillaries adapted to transport air define a lowermost conveying line capillarity, and the capillarity of the substantial majority of the storage capillaries is substantially less than the lowermost conveying line capillarity.

11. A utensil as claimed in claim 9, wherein the capillary storage comprises a plurality of storage capillaries defining respective diameters, the conveying line capillaries adapted to transport air define respective diameters, and the respective diameters of the substantial majority of the conveying line capillaries adapted to transport air are smaller than the respective diameters of the storage capillaries.

12. A utensil as claimed in claim 9, wherein the liquid will be transferred from the first storage area through the conveying line to the capillary storage when air pressure in the first storage area increases relative to air pressure outside the utensil, and the liquid will be recycled from the capillary storage into the conveying line and back into the first storage area when the air pressure in the first storage area decreases relative to the air pressure outside the utensil.

13. A utensil as claimed in claim 1, wherein the capillary storage comprises a plurality of storage capillaries ranging in diameter from a lowermost diameter to an uppermost diameter, the capillary conveying line comprises a plurality of conveying line capillaries defining predetermined diameters, and the biggest capillaries of the conveying line define diameters which are smaller than the diameters of most of the storage capillaries.

14. A utensil as claimed in claim 1, wherein the capillary conveying line defines a lowermost capillarity, and the average capillarity of the storage is substantially less than the lowermost capillarity of the conveying line.

15. A utensil as claimed in claim 1, wherein the liquid will be transferred from the first storage area through the conveying line to the capillary storage when air pressure in the first storage area increases relative to air pressure outside the utensil, and the liquid will be recycled from the capillary storage into the conveying line and back into the first storage area when the air pressure in the first storage area decreases relative to the air pressure outside the utensil.

16. A utensil for dispensing fluid, such as a free ink pen, comprising:

a container defining a first storage area for storing liquid, a second storage area and a barrier separating the first and second storage areas, the barrier including an opening defining a predetermined space extending from the first storage area to the second storage area;

a tip;

a capillary conveying line, including first capillaries adapted to transport air and second capillaries adapted to transport liquid, completely filling the predetermined space defined by the opening in the barrier, the capillary conveying line extending from the opening, through at least a portion of the second storage space to the tip and defining a first predetermined average capillarity;

a capillary storage associated with the second storage area, in direct contact with the capillary conveying line, and separated from the first storage area by the barrier and the capillary conveying line such that the capillary storage only comes into contact with liquid from the first storage area by way of the conveying line, the capillary storage defining a second predetermined average capillarity, the second predetermined average capillarity being substantially less than the first predetermined average capillarity; and said capillaries in the feeder line adapted to transport air having larger capillary size than other capillaries in the feeder line, and having a lesser capillary size than the majority of the capillaries in the capillary store;

whereby the liquid will be recycled from the first storage through the conveying line to the capillary storage when the air pressure in the first storage area increases relative to air pressure outside the utensil; and when the relative air pressure in the first storage area decreases, the liquid will be drawn back from the capillary storage into the conveying line and back into the first storage area in such a manner that a relatively large volume of liquid may be stored without leakage.

* * * * *